United States Patent [19]

Heitert

[11] 4,326,489

[45] Apr. 27, 1982

[54] PROPORTIONAL FLOW FUEL VAPOR PURGE CONTROL DEVICE

[75] Inventor: John S. Heitert, Ringwood, N.J.

[73] Assignee: Ford Motor Company, Dearborn, Mich.

[21] Appl. No.: 107,991

[22] Filed: Dec. 27, 1979

[51] Int. Cl.[3] ..... F02M 33/02

[52] U.S. Cl. ..... 123/520; 123/519

[58] Field of Search ..... 123/518, 519, 520, 521; 251/205; 55/387

[56] References Cited

U.S. PATENT DOCUMENTS

| | | | |
|---|---|---|---|
| 15,163 | 7/1921 | Davis | 251/205 |
| 3,831,353 | 8/1924 | Toth | 55/387 |
| 3,913,545 | 10/1975 | Haase | 123/520 |
| 4,086,897 | 5/1978 | Tamura | 123/520 |

*Primary Examiner*—Charles J. Myhre
*Assistant Examiner*—Carl Stuart Miller
*Attorney, Agent, or Firm*—Robert E. McCollum; Clifford L. Sadler

[57] ABSTRACT

An engine has a fuel evaporative loss control system that includes a canister containing carbon for storing fuel vapors directed into it during engine hot soak conditions, and a purge line leading to the engine intake manifold and containing a purge control valve that meters the purge fuel vapors into the engine proportionate to the air flow rate into the engine.

2 Claims, 4 Drawing Figures

PROPORTIONAL FLOW FUEL VAPOR PURGE CONTROL DEVICE

This invention relates in general to an automotive type internal combustion engine and more particularly to a control device for variable controlling the purge of fuel vapors from a conventional carbon canister back into the engine.

Carbon canister storage systems are known for storing fuel vapors emitted from an automotive type fuel tank or carburetor float bowl or other similar fuel reservoir, to prevent emission into the atmosphere of fuel evaporative components. These systems usually consist of a canister containing carbon with an inlet from the fuel tank or other reservoir so that when the fuel vaporizes under a hot soak, the vapors will flow either by gravity of under vapor pressure into the canister to be adsorbed by the carbon therein and stored. Subsequently, in most instances, a purge line connected from the canister outlet to the carburetor or engine intake manifold purges the stored vapors into the engine during engine operation in response to the manifold vacuum singals therein. The canister contains a purge fresh air inlet to cause a sweep of the air across the carbon particles to thereby desorb the carbon of the fuel vapors.

In most instances, a purge or nonpurge of vapors is an on/off type proposition. That is, either the purge flow is total or zero. For example, U.S. Pat. No. 3,831,353, Toth, fuel vapor control device, assigned to the assignee of this invention, shows a fuel evaporative control system and assoicated canister for storing fuel vapors and subsequently purging them back into the engine air cleaner. However, there is no control valve mechanism to vary the quantity of purge flow. As soon as the throttle valve is open, the fuel vapors are purged continuously at essentially a constant rate into the manifold.

It is an object of this invention to provide a fuel vapor purge control device that permits a purge of fuel vapors at a rate that is proportional to air intake flow into the engine to more accurately control the air/fuel ratio of the mixture passing into the engine.

Another object of the invention is to provide a fuel vapor purge control device that includes a vacuum servo mechanism connected to a valve member that is slidable across a metering slot to provide a variable flow area responsive to changes in engine intake manifold vacuum to accurately meter the re-entry of fuel vapors into the engine proportionate to engine air flow.

Figure 1:
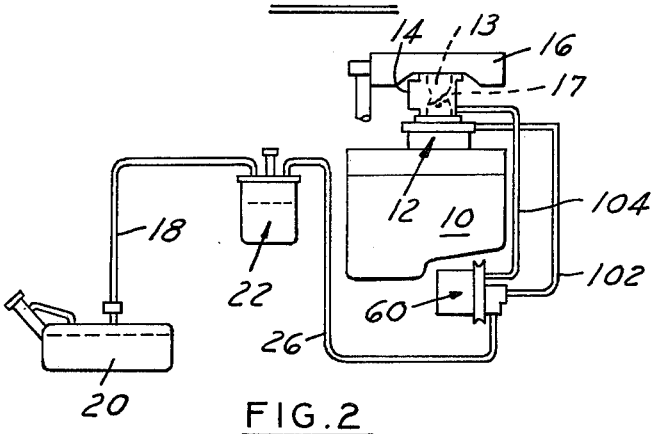
Figure 2:
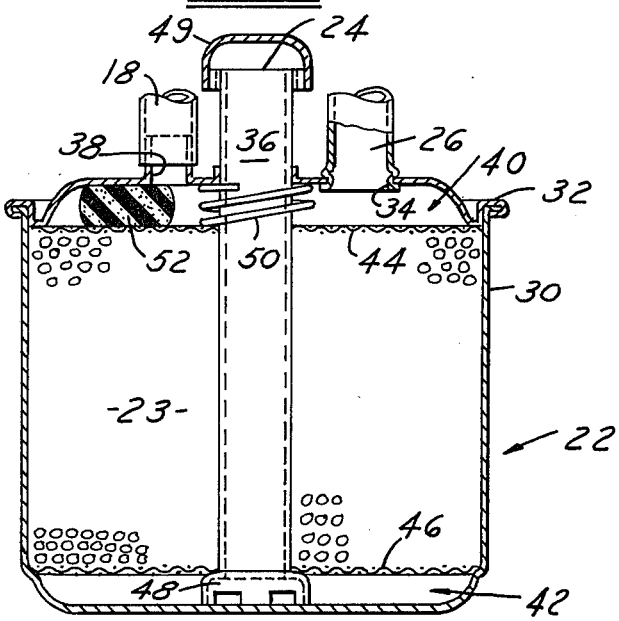
Figure 4:
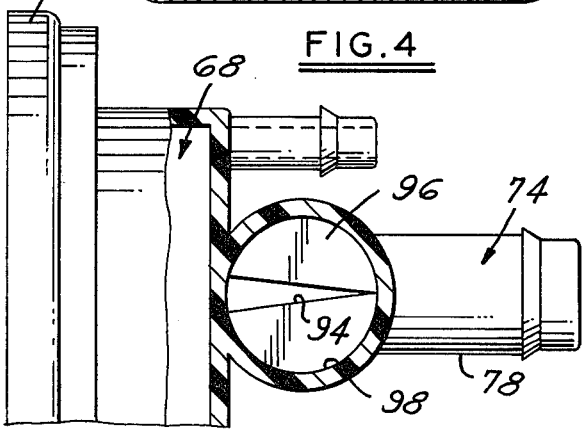
Figure 3:
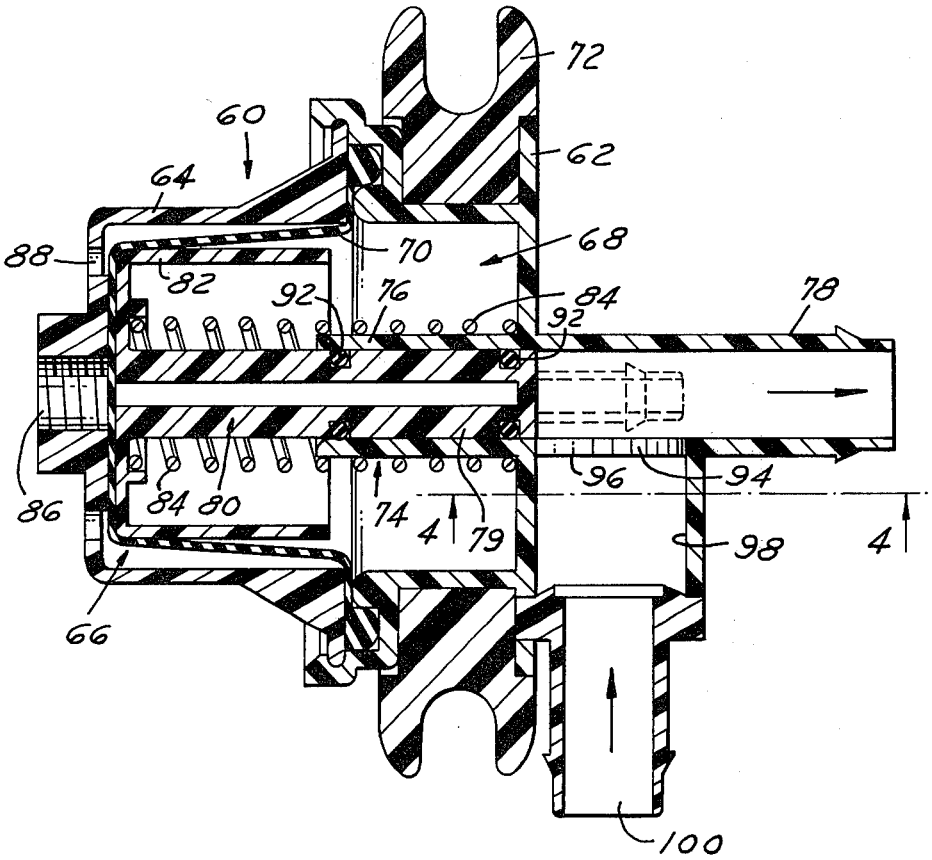

Other objects, features and advantages of the invention will become more apparent upon reference to the succeeding detailed description thereof, and to the drawings illustrating the preferred embodiment thereof, wherein;

FIG. 1 schematically illustrates a fuel vapor loss control system embodying the invention;

FIGS. 2 and 3 are enlarged cross-sectional views of details of the system shown in FIG. 1; and, FIG. 4 is a cross-sectional view taken on a plane indicated by and viewed in the direction of the arrows 4—4 of FIG. 3.

FIG. 1 illustrates schematically a typical fuel vapor loss control system for use with a motor vehicle power plant. It shows a conventional engine 10 having mounted thereon a carburetor 12 with an induction passage 13 and a fuel or float bowl 14. The air taken into the carburetor and engine is filtered by a conventional air cleaner 16 having a suitable dry filter element such as, for example, of the pleated paper type. The flow of air is controlled by a throttle valve 17 rotatably mounted in the walls of the carburetor body.

The fuel vapor loss control system includes a vent line 18 connected at one end to the vehicle fuel tank 20 and to a vapor storage canister 22 at the other end. As seen in FIG. 2, the canister contains a quantity of activated charcoal 23 that will adsorb and store fuel vapors. The vapors enter therein under slight pressure from the fuel tank when engine hot soak conditions occur.

The canister has a fresh air inlet 24 and a purge outlet tube or line 26. A hollow outer shell 30 closes the canister 22 at its upper end by means of a beaded cover member 32. The cover has an opening 34 in which tube 26 is fixed, an opening in which fresh air inlet tube 36 is fixed, connected to inlet 24, and a fuel vapor opening 38 connected to line 18.

The interior of the shell 30 is partitioned into two end chambers 40 and 42 by a pair of annular steel perforated screen plates 44 and 46, the space between the screens being filled with activated charcoal or some other suitable vapor adsorbent 23. The two end chambers 40 and 42 constitute fluid distribution manifolds so that the fuel vapors and air will be evenly distributed over the entire end surfaces of the activated charcoal. If chambers 40 and 42 were not provided, then any flow of air down the fresh air tube 36 would tend to return along its outer diameter to soon saturate the adsorbent to a point where further flow of fuel vapors would cause a breakthrough without adsorption. That is, rather than spread laterally to pass through unsaturated adsorbent, the fuel vapors would pass in a shorter, easier path over the saturated elements and, therefore, fuel vapor would pass out into the atmosphere through the purge tube prior to the capacity of the adsorbent being utilized.

The fresh air tube 36 extends through cover 32, manifold 40 and both screens 44 and 46 into the opposite end chamber 42, with a suitable spacer element 48 on the end of the tube. A dust cap 49 covers the fresh air inlet end 24 of the tube, and a spring 50 located between screen 44 and the cover 32 biases the upper screen against the activated adsorbent to maintain it in place.

The canister is constructed as described above so that the fuel vapors forced into manifold 40 will pass through the activated charcoal and be adsorbed thereon. The connection of the fresh air to the end chamber 42 through tube 36, with the purge outlet 34 being at the opposite end chamber 40, forces a flow of air through the charcoal from one end to the other during the purge operation when the engine is running, thereby desorbing the fuel vapors.

Completing the construction, a baffle member 52 is interposed in the upper manifold 40 between the vapor inlet 38 and the purge outlet 34 to positively prevent the escape of fuel vapors into the atmosphere without having first passed through and being adsorbed and stored by the activated charcoal elements.

The baffle 52 in this case consists of a compressible open cell, foam material of an essentially rectangular shape and has a central arcuate portion merely to avoid interference with spring 50. The open cell foam baffle has a very small porosity, which causes a high restriction to flow through it so that fuel vapor cannot freely flow through the baffle member and thereby bypass the charcoal elements during the purge or storage operations.

In operation, as thus far described, when the engine in FIG. 1 is shut down and the fuel tank experiences a temperature gradient large enough to cause the evaporation of considerable fuel vapor from the tank, the fuel vapor under slight pressure will pass up into line 18 and into the canister inlet 38. At this time, fuel vapors will flow into the space between the baffle 52 and the end of chamber 40 and therefrom be forced into the bed of activated charcoal 23 to be adsorbed thereon.

When the engine is again restarted, the intake manifold depression will under the conditions to be described, cause a flow of air through the fresh air inlet opening 24 and through the tube 36 to the bottom manifold 42. It will then flow upwardly towards the purge outlet 34 through the activated charcoal and thus desorb the charcoal of fuel vapors.

Turning now to the invention, the purge control line 26 contains a fuel vapor purge control device 60 for controlling the flow of purge vapor back into the engine. More particularly, referring to FIGS. 3 and 4, device 60 consists of a two-piece housing 62, 64 connected by any suitable means, not shown. A hollow interior of the housing is partitioned into an air chamber 66 and a vacuum chamber 68 by an annular flexible diaphragm 70. The diaphragm is edge mounted in the housing by being sandwiched between the two housing portions 62 and 64, as shown. The housing portion 62 includes a mounting flange 72 and a cylindrical or tubular central portion 74. The one end 76 of the tubular portion is adapted to slidably receive therein the metering end 79 of a piston rod type metering valve 80. The opposite end of the valve 80 is integral with a piston shaped diaphragm and spring retainer 82.

The housing member 64 constitutes a cover and also defines a stop for the leftward movement of diaphragm 70 and piston member 82. A spring 84, seated between the inside of the piston member 82 and a portion of the housing 62 at the opposite end normally biases the diaphragm 70 and metering valve 80 to the position shown in FIG. 3. An adjustment hole 86 is shown for receiving a bolt, screw or the like for varying the stopped position of metering valve 80. The cover 64 contains an opening 88 for venting the chamber 66 to ambient or atmospheric air. The rightward (as seen in FIG. 3) end 78 of metering valve 80 is sealingly mounted in the bore of tube 74 by a number of O-rings.

As best seen in FIGS. 3 and 4, the rightward end of tube 74 (as seen in FIG. 3) contains a conically shaped flow outlet 94 that tapers as shown to converge in a direction towards the open end of tube 74. The outlet is located in the wall 96 so as to be parallel with the direction of movement of the metering valve 80 so that longitudinal movement of the valve will thereby progressively open or close the conical slot 94 and thereby control flow from one side of the slot to the other. The housing portion 62 contains a projection type passage 98 extending from the wall portion containing the metering slot, and mounts a tube type adapter 100 connected to the purge line 26 shown in FIG. 1. Thus, flow of purge air from the carbon canister flows in a direction through the metering slot at right angles to the direction of movement of the metering valve 80. This permits the metering valve to effectively variably close the metering slot by sliding across the face of the slot.

The open end of tube 74 is in this case adapted to be connected to a line 102 that is connected to the carburetor induction passage below the throttle valve or alternatively to the spacer between the carburetor and intake manifold to return the purged fuel vapors into the engine to be subsequently burned.

Completing the construction, the vacuum chamber 68 is also connected to the carburetor induction passage by a tube 104 at a point below the closed position of the throttle valve so as to be subject to the changing level of the intake manifold vacuum at all times.

In operation, therefore, when the engine is shut down for a period sufficient to provide a hot soak condition, fuel vapors generated in the fuel tank will cause a movement of them into the carbon canister 22 to be adsorbed by the carbon therein. When the engine is restarted, the intake manifold vacuum acting on the right end of tube 74 will initially attempt to cause a flow of fresh air through the canister inlet 24 and through the charcoal to desorb the vapors therefrom into purge line 26. Simultaneously, the high intake manifold vacuum prevalent in the intake manifold and in purge valve chamber 68 will draw the piston type metering valve 80 rightwardly as seen in FIG. 3 its maximum extent to close off the conically shaped metering slot 94. Subsequently, as the throttle valve is opened, the decrease in manifold vacuum will permit the force of spring 84 to move the metering valve 80 leftwardly as seen in FIG. 3 to progressively uncover the metering slot 94 and permit purge flow of fuel vapors into the engine. As will be seen, this will be proportionate to the flow rate of the air flowing into the carburetor induction passage and thus the device will be seen as a proportional purge valve having a fuel vapor flow proportional to air flow through the engine.

From the foregoing, it will be seen that the invention provides a fuel vapor purge control device that controls the flow of fuel vapor back into the engine in proportion to the amount of air flow into the engine, thus providing an accurate control of the air/fuel ratio of the mixture flow to the engine. It will also be seen that the invention provides a purge control valve that is simple in construction and efficient in operation and economical to manufacture.

While the invention has been shown and described in its preferred embodiment, it will be clear to those skilled in the arts to which it pertains that many changes and modifications may be made thereto without departing from the scope of the invention.

I claim:

1. A fuel vapor purge control device for use with an automotive type internal combustion engine having a carburetor with an induction passage controlled by a movable throttle valve and a fuel float bowl, a fuel tank, a fuel vapor storage canister having a purge air inlet and a vapor inlet and a purge outlet, and passage means connecting the vapors from the fuel tank to the canister for flow into the storage therein during engine shutdown, and vapor purge passage means connecting the outlet to the induction passage for purging the vapors from the canister into the carburetor during engine operation in response to opening of the throttle valve, the carburetor having a manifold vacuum port in the induction passage at a location below the throttle valve to be subject to changing manifold vacuum levels as the throttle valve moves open, the purge device comprising a variable area flow control means in the purge passage means variably movable in response to the changing port vacuum levels upon opening of the throttle valve to provide a purge flow of vapors that varies in proportion to the flow of air through the induction passage, the control means including a conically shaped metering slot in the purge passage means, a valve member movable across the slot to selectively and progressively block and unblock the slot opening to control the mass flow of vapors through the slot, and vacuum responsive servo means connected to the pressure port and to the valve member to vary the position of the valve member and the opening area of the slot in inverse proportion to the manifold vacuum level, the servo means including piston means operable in response to the level of manifold vacuum during a closed throttle condition to close the valve member, the manifold vacuum progressively decaying upon opening of the throttle valve to progressively move the piston means and valve member towards a further open position.

2. A fuel vapor purge control device for use with an automotive type internal combustion engine having a carburetor with an induction passage controlled by a movable throttle valve and a fuel float bowl, a fuel tank, a fuel vapor storage canister having a purge air inlet and a vapor inlet and a purge outlet, and passage means connecting the vapors from the fuel tank to the canister for flow into and storage therein during engine shutdown, and vapor purge passage means connecting the outlet to the induction passage for purging the vapors from the canister into the carburetor during engine operation in response to opening of the throttle valve, the carburetor having a manifold vacuum port in the induction passage at a location below the throttle valve to be subject to changing manifold vacuum levels as the throttle valve moves open, the purge device comprising a variable area flow control means in the purge passage means variabley movable in response to the changing port vacuum levels upon opening of the throttle valve to provide a purge flow of vapors that varies in proportion to the flow of air through the induction passage, the control means including a conically shaped metering slot in the purge passage means, a valve member movable across the slot to selectively and progressively block and unblock the slot opening to control the mass flow of vapors through the slot, vacuum responsive servo means connected to the carburetor pressure port and to the valve member for variable moving it in response to opening of the throttle valve, the servo means including piston means operable in response to the level of manifold vacuum during a closed throttle condition to close the valve member, the manifold vacuum progressively decaying upon opening of the throttle valve to progressively move the piston means and valve member towards a further open position, and spring means biasing the valve member to a failsafe open position providing maximum flow through the metering slot.

* * * * *